US006569028B1

(12) United States Patent
Nichols et al.

(10) Patent No.: US 6,569,028 B1
(45) Date of Patent: May 27, 2003

(54) GOLF DRIVING RANGE

(75) Inventors: Thomas J. Nichols, Phoenix, AZ (US); James Bertoncino, Phoenix, AZ (US); Russell C. Brown, Phoenix, AZ (US)

(73) Assignee: GlowRange, L.L.C., Phoenix, AZ (US)

( * ) Notice: Subject to any disclaimer, the term of this patent is extended or adjusted under 35 U.S.C. 154(b) by 0 days.

(21) Appl. No.: 09/493,850

(22) Filed: Jan. 28, 2000

Related U.S. Application Data

(60) Provisional application No. 60/117,615, filed on Jan. 28, 1995.

(51) Int. Cl.[7] ..... A63B 69/36

(52) U.S. Cl. ..... 473/192; 473/191; 473/153; 473/168

(58) Field of Search ..... 473/167–172, 473/353, 191, 192, 153, 154

(56) References Cited

U.S. PATENT DOCUMENTS

| | | | | |
|---|---|---|---|---|
| 2,825,565 A | | 3/1958 | Hooker | 273/125 |
| 3,104,879 A | | 9/1963 | Jetton | 273/176 |
| 3,310,310 A | | 3/1967 | McKee | |
| 3,708,173 A | | 1/1973 | Hewson, Jr. | 273/176 A |
| 3,782,730 A | | 1/1974 | Horchler | 273/213 |
| 3,868,692 A | | 2/1975 | Woodard et al. | 343/112 |
| 3,897,947 A | | 8/1975 | Heffley, Jr. | 273/35 B |
| 4,042,491 A | | 8/1977 | Hazeltine et al. | 209/4 R |
| 4,045,023 A | | 8/1977 | Heffley, Jr. | |
| 5,029,866 A | | 7/1991 | Beard, III et al. | 273/181 R |
| 5,033,745 A | | 7/1991 | Sullivan et al. | 273/184 R |
| 5,066,008 A | | 11/1991 | Rivera | 273/2 |
| 5,083,113 A | | 1/1992 | Slawinski et al. | 340/572 |
| 5,114,155 A | | 5/1992 | Tillery et al. | 273/371 |
| 5,163,677 A | | 11/1992 | Foley | 273/35 B |
| 5,163,684 A | | 11/1992 | Seidler | |
| 5,265,875 A | | 11/1993 | Fitzgerald | |
| 5,330,195 A | * | 7/1994 | Gulick | 473/353 |
| 5,370,389 A | | 12/1994 | Reising | 273/35 B |
| 5,439,224 A | | 8/1995 | Bertoncino | 273/182 A |
| 5,513,841 A | | 5/1996 | Takagi | |
| 6,322,455 B1 | * | 11/2001 | Howey | 273/461 |

FOREIGN PATENT DOCUMENTS

| | | |
|---|---|---|
| GB | 2119261 A | 11/1983 |
| WO | WO 00/48691 A3 | 8/2000 |

OTHER PUBLICATIONS

Bradshaw, K., *Range Business Drives Forward at PGA Show,* www.PGA.com—International Golf Show, Sep. 28–30, 1999, http://www.pga.com/Expos/Intl_99/Shownews/range.html.

Goodenough, T., *A Shot In The Dark,* Ahwatukee Foothills News, Dec. 29, 1999, http://www.ahwatukee.com/afn/sports/articles/991229b.html.

* cited by examiner

*Primary Examiner*—Mark S. Graham
(74) *Attorney, Agent, or Firm*—Snell & Wilmer

(57) ABSTRACT

A system for facilitating the practicing or playing of golf may include, alone or in combination, a golf target subsystem, a detection subsystem, and a golf ball dispensing subsystem. The golf ball dispensing subsystem comprises a free standing device placed at the teeing area which may be configured to provide various functions, such as, for example, receiving and storing a quantity of golf balls, exposing non-illuminated golf balls to an illuminating source contained therein, and thereby illuminating the golf balls, and/or dispensing the illuminated golf balls to the golfer. The golf target subsystem is suitably configured to permit a golfer to locate and identify the target area while addressing the golf ball so that the golfer may attempt to land the golf ball within the target area. In addition, to facilitate the identification of the target during nighttime conditions, i.e., conditions without external lighting, the golf target is preferably illuminated.

20 Claims, 5 Drawing Sheets

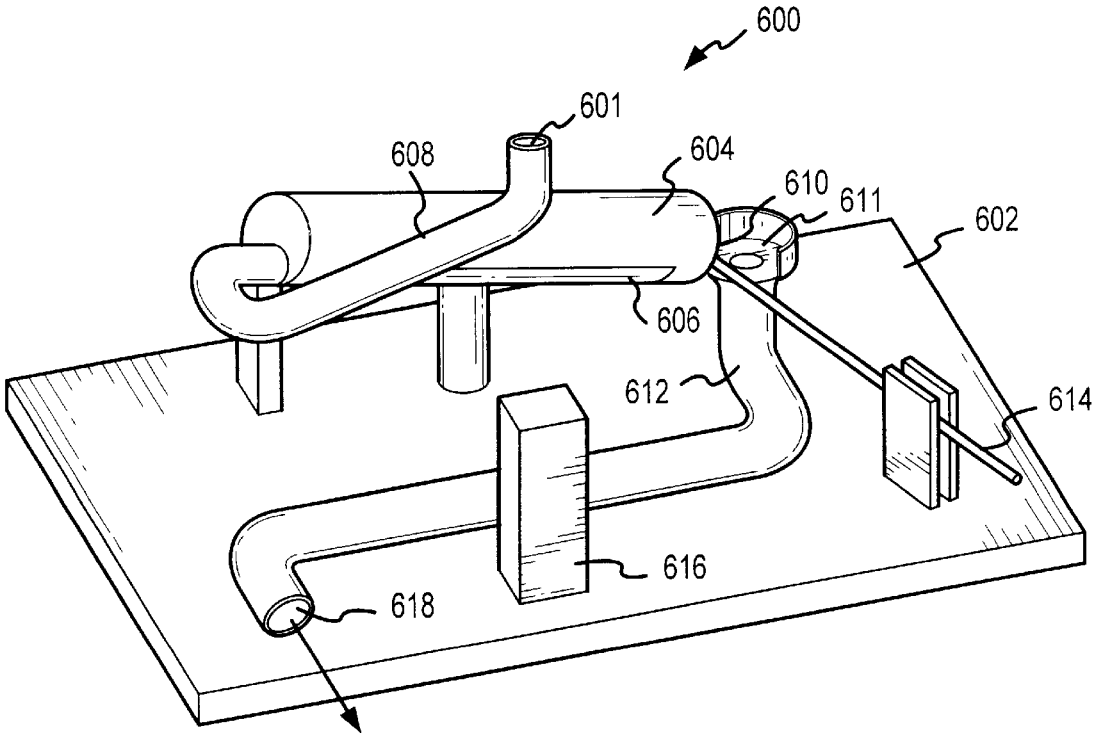
FIG.6
FIG.4
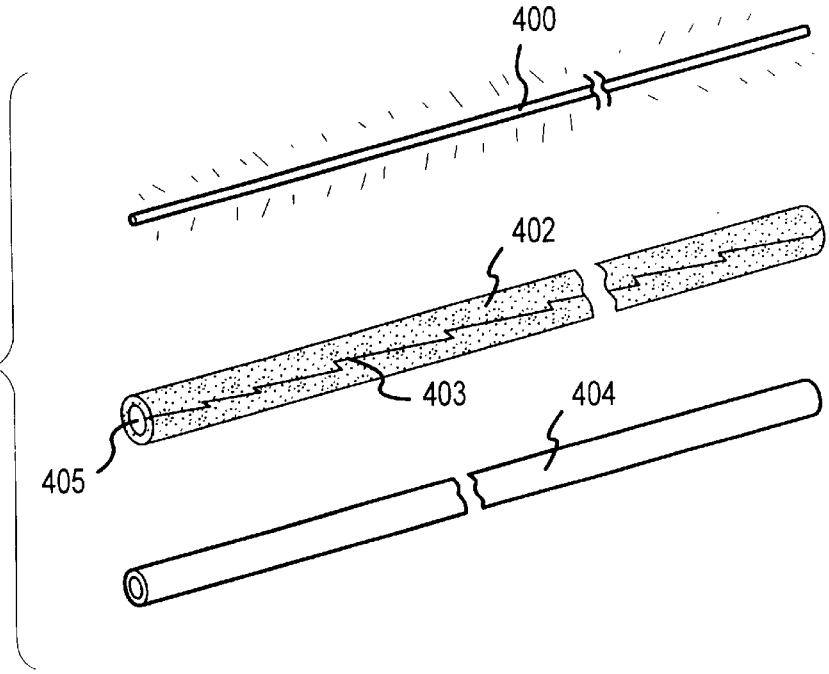

GOLF DRIVING RANGE

CROSS-REFERENCES TO RELATED APPLICATION

This is an application which claims priority from U.S. Provisional Application Ser. No. 60/117,615, filed Jan. 28, 1999.

FIELD OF THE INVENTION

The present invention relates to a driving range for golfing, and more particularly to a golf targeting system configured to facilitate the practicing and/or playing of golf through the use of a performance feedback subsystem, and which may be illuminated to permit the practicing and/or playing of golf without the use of external lighting.

BACKGROUND OF THE INVENTION

The participation in the sport of golf continues to increase at a healthy rate. This notable increase has been a result of a variety of factors, such as, for example, an increase in the marketing of the game towards people of all ages, the manufacturing of golf clubs and equipment at prices more affordable to many golfers, and the increased number of currently available golf courses and related driving ranges.

Most traditional golf driving ranges permit golfers to practice on their general swinging mechanics, without much focus towards the targeting of their shots, and without the ability to objectively gauge their progress or success. For example, typical golf driving ranges provide a driving area or platform and an open field to allow the driving or hitting of golf balls. In many instances, there are no targets available other than an occasional distance marker, for example, every fifty yards. On other occasions, some driving ranges provide a flag or pole positioned at various distances around the driving range. At best, some driving ranges provide a landing area, i.e., a simulated putting green with a flag designating the hole. Regardless of the type of functionally limited target utilized by conventional driving ranges, and other than a limited visual determination by the golfer as to whether a particular shot landed approximate the target, these conventional driving ranges do not provide a detailed indication as to the proximity of the golf ball to the target. In addition, because many golfers may be attempting shots at the same flag or putting green, due to an accumulation of balls around a target area throughout the course of a day, it is difficult if not impossible for an individual golfer to assess their performance from a practice session.

In addition, most traditional golf driving ranges are only available to golfers during daylight hours so as to enable a golfer to-suitably follow the flight of the golf ball when struck, and thus evaluate his or her golf swing. The few driving ranges that do operate after daylight, i.e., in the evening or at night, typically require external lighting systems to enable a golfer to follow or track the golf ball upon impact. However, in addition to the potentially displeasing impact on surrounding residences, these external lighting systems for nighttime driving ranges are generally expensive and often cannot assist the golfer in tracking the complete flight of the golf ball. Further, although a golfer may be able to moderately track the flight of the golf ball, difficulty often exists in evaluating the end results of a particular swing.

Accordingly, an improved driving range is needed that can provide a golfer with an evaluation of performance based of the golfer's swing as well as the end results. Further, a need exists for an improved driving range which eliminates the need for external lighting at night and thus facilitates and enhances the practice, playing and/or teaching of golf at any time of the day or night.

SUMMARY OF THE INVENTION

A driving range according to the present invention addresses many of the shortcomings of the prior art. In accordance with the present invention, a system for facilitating the practicing or playing of golf may include, alone or in combination, a golf target subsystem, a detection subsystem, and a golf ball dispensing subsystem.

In accordance with one aspect of the present invention, the golf ball dispensing subsystem preferably comprises a free standing device placed at the teeing area which may be configured to provide various functions, such as, for example, receiving and storing a quantity of golf balls, exposing non-illuminated golf balls to an illuminating source contained therein, and thereby illuminating the golf balls, and/or dispensing the illuminated golf balls to the golfer. In addition, an exemplary golf ball dispensing subsystem may also include various other features, such as swing speed and tempo indicators, distance measuring equipment, laser alignment for golf swings, and video or other like displays.

In accordance with another aspect of the present invention, the golf target subsystem is suitably configured to permit a golfer to locate and identify the target area while addressing the golf ball so that the golfer may attempt to land the golf ball within the target area. To facilitate the identification of the target area during daytime conditions, the golf target subsystem may include fluorescent or other brightly colored members to provide a more visible golf target. In addition, to facilitate the identification of the target during nighttime conditions, i.e., conditions without external lighting, the golf target is preferably illuminated. Additionally, the target area may be configured in various shapes, such as the design of a putting green, a circle, an octagon and the like, and/or as a single vertical pole or "flagstick" design. Moreover, the target may comprise a plurality of circular or other shapes configured with different perimeters to provide smaller and/or larger target areas within the golf target subsystem.

In accordance with another aspect of the present invention, the detection subsystem is suitably configured to determine whether a golf ball has landed within a perimeter of the target subsystem. In accordance with this aspect, a barrier portion may be provided to cover the target area and suitably receive any golf balls landing within the perimeter of the target area. Thereafter, any such golf balls may be directed to the detection subsystem to permit the detection of the golf ball within the target area. Upon detection, a signal may be provided by the detection subsystem to indicate the presence of a golf ball within the perimeter of the target. In addition, the individual accuracy of a golfer for a single practice or game or an accumulation of various practice rounds or games may be determined.

BRIEF DESCRIPTION OF THE DRAWINGS

A more complete understanding of the present invention may be derived by referring to the detailed description when considered in connection with the Figures, where like reference numbers refer to similar elements throughout the Figures, and:

FIG. 4 is a perspective view of various exemplary components comprising the framing members of a golf target subsystem in accordance with the present invention

FIG. 6 is a perspective view of a golf ball dispensing device in accordance with another exemplary embodiment of the present invention;

DETAILED DESCRIPTION OF PREFERRED EMBODIMENTS OF THE INVENTION

The present invention may be described in terms of various materials and components. It should be appreciated that such materials and components may be realized by any number of materials, components, elements and devices configured to perform the specified functions. For example, the present invention may employ various known or hereinafter devised methods for illuminating golf balls as may utilized in accordance with the present invention. Further, it should be noted that the driving range described herein is merely one exemplary application for the invention. For example, rather than a traditionally sized driving range for practicing tee shots, or shorter "wedge" shots, the present invention may also be practiced in smaller, more compact locations, such as in the backyard of an individual's home, or within the confines of an indoor gymnasium.

As discussed above, regardless of the type of functionally limited target that is utilized, conventional driving ranges do not provide a detailed indication as to the proximity of the golf ball to the target. In addition, due to an accumulation of balls around a target area throughout the course of a day, it is difficult if not impossible for an individual golfer to assess their performance from a single practice session at conventional driving ranges However, in accordance with the present invention, a system for facilitating the practicing and/or playing of golf can be provided which allows a golfer to more readily evaluate and assess their individual performance.

Figure 1:
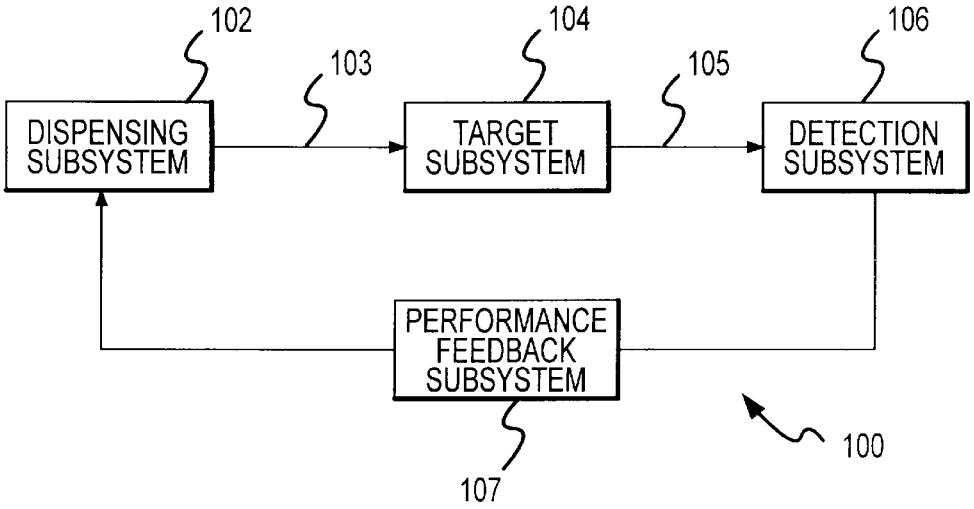
FIG. 1 is a schematic diagram of a system for practicing golf in accordance with the present invention.

In accordance with the present invention, with reference to FIG. 1, a system 100 for facilitating the practicing of golf suitably comprises a dispensing subsystem 102 and a target subsystem 104. Dispensing subsystem 102 suitably comprises a free standing device placed at the teeing area to provide the dispensing of golf balls upon request by a golfer. In addition, dispensing subsystem 102 may be configured to provide various other functions, such as, for example, receiving and/or storing a quantity of golf balls.

Target subsystem 104 suitably provides a target that is suitably configured to permit a golfer to locate and identify the target area while addressing the golf ball so that the golfer may attempt to land the golf ball on the target area. The target of target subsystem 104 may be configured in various shapes, such as the design of a putting green, a circle, an octagon and the like, and/or as a single vertical pole or "flagstick" design. Preferably, target subsystem 104 comprises a rigid frame, such as, for example, steel, fiberglass, or plastic tubing and the like, and includes a covering, such as, for example, a barrier netting, that is attached to the frame and placed over the target area. Moreover, the frame preferably has extruded perimeters which may be configured with fluorescent-like or other brightly colored members so as to be more readily visible from the teeing area. Additionally, target subsystem 104 may comprise a plurality of golf targets of similar or different sizes, shapes, and orientations.

In accordance with another aspect of the present invention, system 100 may also include a detection subsystem 106. In accordance with this aspect of the present invention, detection subsystem 106 suitably comprises a detector device configured to permit a golfer to readily determine whether a golf ball landed within a perimeter of the target subsystem. It should be noted that golf balls may land within a perimeter of the target subsystem from a direct flight from the teeing area, or may suitably bounce onto the target subsystem. Preferably, a barrier portion is provided to cover the target and suitably receive any golf balls landing or otherwise contained within the perimeter of the target. Thereafter, any such golf balls may be directed to detection subsystem 106 to permit the detection of the golf ball within the target. Upon detection, a signal, such as an alarm light or sound, may be provided by detection subsystem 106 to indicate the presence of a golf ball within the perimeter of the target. In addition, as will be described in more detail below, the accuracy of a golfer for a single practice session or game or an accumulation of various practice rounds or games may be determined.

It should be noted that system 100 may comprise various combinations of subsystems 102, 104 and 106 without departing from the scope of the present invention. For example, system 100 may consist of dispensing subsystem 102 and target subsystem 104, i.e., without detection subsystem 106. Alternatively, system 100 may consist of target subsystem 104 and detection subsystem 106, i.e., without dispensing subsystem 102. Further, system 100 may suitably include dispensing subsystem 102, target subsystem 104 and detection subsystem 106. Accordingly, system 100 may suitably include alone or in any combination subsystems 102, 104 and 106 without departing from the scope of the present invention.

As discussed above, most traditional golf driving ranges are only available to golfers during daylight hours so as to enable a golfer to suitably follow the flight of the golf ball when struck. The few driving ranges that do operate after daylight typically require external lighting systems to enable a golfer to follow or track the golf ball upon impact. Further, although a golfer may be able to moderately track the flight of the golf ball, difficulty often exists in evaluating the end results of a particular swing.

In accordance with another aspect of the present invention, system 100 may also be configured to permit the practicing or playing of golf at night without external lighting. In accordance with this aspect of the present invention, system 100 suitably comprises golf balls capable of illumination that are used along with dispensing subsystem 102 and target subsystem 104. Preferably, the golf balls are capable of phosphorescent illumination by virtue of containing phosphorus or other phosphorescent type material in their outer cover. For example, one type of golf ball usable in an illumination embodiment of system 100 is the golf ball sold under the trademark GLOWOWL. However, other types of golf balls capable of phosphorescent illumination can be used as well. Alternatively, the golf balls need not be capable of phosphorescent illumination, i.e., any type of illumination process now known or hereinafter devised may be utilized in accordance with the present invention. For example, a golf ball configured with an illuminating member suitably inserted into the core of the ball or otherwise attached to provide illumination may also be utilized.

The golf balls may be suitably transported to dispensing subsystem 102 by various devices. For example, the golf balls may be emptied into dispensing subsystem 102 from a small bucket or container and the like, or may be emptied from storage tubes, as will be described in more detail below.

Continuing in accordance with this aspect of the present invention, dispensing subsystem 102 may be configured for exposing non-illuminated golf balls to an illuminating source contained therein and thereby illuminating the golf balls prior to dispensing to the golfer, as will be described in more detail below. This illumination of the golf balls allows the golfer to more readily track the path of flight of the golf balls towards the target area. Further, to provide a more visible target area in the day, or at night without external lighting, target subsystem 104 suitably comprises an illumination system that can illuminate the target area, as will be described in more detail below.

Having described in general detail an exemplary system 100 for practicing golf, an example of the operation of system 100 will now be provided. Initially, a plurality of golf balls may be stored in dispensing subsystem 102 and suitably dispensed, preferably one at a time, to a golfer. In addition, the golf balls may be illuminated if desired. The golfer may then hit the golf ball in a path 103 towards the target area of target subsystem 104, which may be illuminated to facilitate nighttime operations. In the event the golf ball lands directly or bounces onto, or is otherwise contained on the target area, the golf ball may be suitably transferred 105 by target subsystem 104 and detected by detection subsystem 106. To assist this transfer of the golf ball, it should be noted that detection subsystem 106 may be suitably coupled or connected to target subsystem 104, i.e., either directly connected or approximately located to target subsystem 104. Accordingly, detection subsystem 106 may suitably provide a performance feedback signal 107, such as a reporting output signal, an alarm light and/or sound and the like, which indicates that the ball landed, either from direct flight or from a bounce, within the target area of target subsystem 104. However, it should be noted that this exemplary operation of system 100 may be configured in various other manners in accordance with the present invention.

Having described an exemplary system 100 and an exemplary operation of such a system 100, various exemplary embodiments of subsystems 102, 104 and 106 will now be discussed in more detail.

Dispensing Subsystem

Dispensing subsystem 102 may be configured in a variety of embodiments to allow a golfer to obtain access to golf balls for hitting towards the target area. Dispensing subsystem 102 suitably comprises a free standing device placed at or near the teeing area to provide the dispensing of golf balls upon request by a golfer. In addition, dispensing subsystem 102 may be configured to provide various other functions, such as, for example, receiving and/or storing a quantity of golf balls.

Figure 5A:
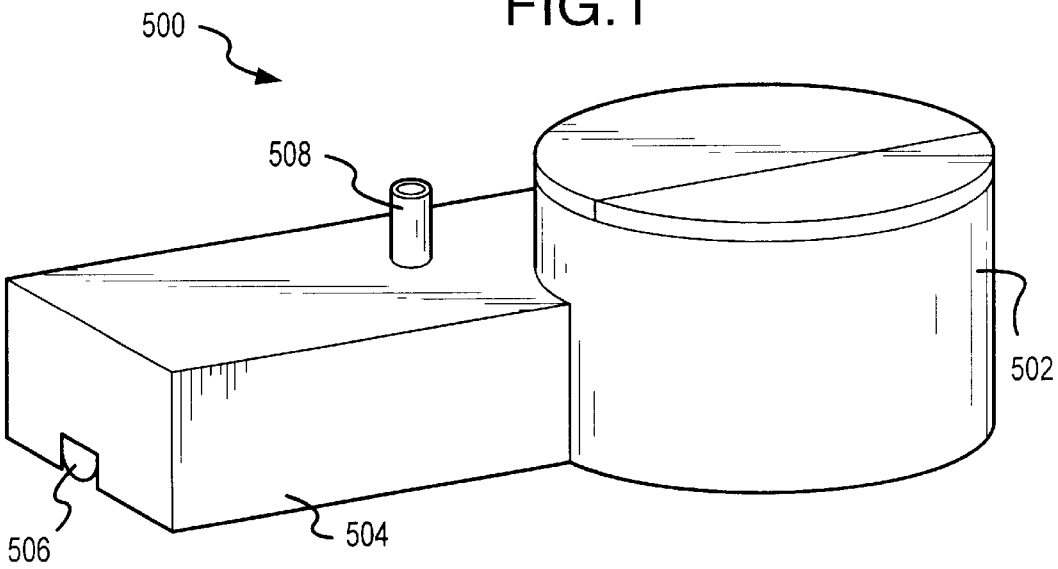
FIG. 5A is a perspective view of an exemplary golf dispensing device in accordance with one embodiment of the present invention.
Figure 5B:
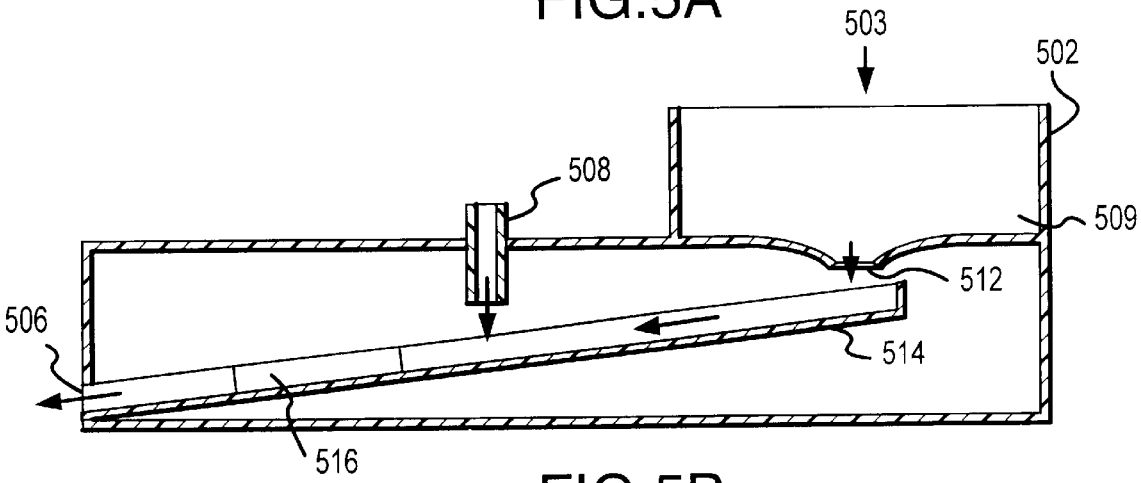
FIG. 5B is a cross-sectional view of the exemplary golf ball dispensing device illustrated in FIG. 5A.

With reference to FIGS. 5A and 5B, an exemplary embodiment of dispensing subsystem 102 is shown including a dispensing device 500. Dispensing device 500 preferably comprises a container portion 502 having an opening 503 configured for receiving golf balls, a storage area 509 configured for storing golf balls, and an opening 506 configured for dispensing golf balls. Preferably, container portion 502 comprises a rigid material, such as, for example, plastic, fiberglass, metal, or wood and the like, that facilitates the storage of numerous golf balls, for example, between 50 and 500 golf balls. In addition, container portion 502 may include a lid or other covering suitably configured to cover opening 503 and storage area 509, or opening 503 and storage area 509 may be left uncovered. Further, container portion 502 may have an opening 512 for dispensing golf balls into a dispensing section 504. Moreover, Dispensing device 500 may suitably include an agitator device or the like, such as may be used with gumball machine type dispensers, and which is configured to prevent golf balls from clogging or otherwise jamming within dispensing device 500.

Dispensing device 500 also comprises an inner track 514 configured to organize and align the golf balls in preparation for dispensing. Inner track 514 comprises a variety of configurations, such as, for example, a tube-like structure or a two-sided frame member, suitably configured to guide the golf balls along dispensing section 504 of dispensing device 500. To facilitate the transporting of golf balls through opening 506, track 514 may be configured in a downward sloping angle. In accordance with one aspect of the present invention, to aid the illumination process, inner track 514 may comprise a reflective-type material to permit an illuminating source to more effectively reflect onto the golf balls.

Dispensing device 500 may also include an illuminating device 516 to provide an illumination source to the non-illuminated golf balls. Illuminating device 516 preferably comprises a black light source configured to illuminate the golf balls. However, illuminating device 516 may comprise any known or hereinafter devised device or means for illuminating objects such as golf balls, for example, a photographic flash-type device and the like. Moreover, illuminating device 516 need not be located within dispensing device 500. Further, neither device 500 or device 516 needs to be placed at the teeing area nor needs to be of any particular type of construction or design.

Opening 506 is suitably configured to dispense a golf ball upon request by the golfer. Opening 506 may comprise a gate-like device configured to permit the dispensing of a single golf ball upon activation of a requesting device, such as, for example, a foot pedal, a handle, or push-button and the like, by the golfer. Further, opening 506 may also comprise a short platform and/or a stop device. In accordance with this aspect, a golfer may directly retrieve the golf ball from the short platform, thus allowing the next golf ball to advance to the stop device.

Dispensing device may also suitably comprise a by-pass tube 508 configured to permit golf balls to be entered onto track 514 ahead of any golf balls located in storage area 509. As will be described below, this feature may be useful for the tracking of specially-identified golf balls which are configured to track the individual performance of a particular golfer or group of golfers.

Accordingly, during operation of exemplary dispensing device 500, golf balls, typically non-illuminated, may be delivered into opening 503 for storing in storage area 509. Upon being stored, the golf balls may be routed by inner track 514 to opening 506. Additionally, if desired, the golf balls may be routed by inner track 514 through illuminating device 516, exposing the golf balls to the illuminating light source and thus illuminating the golf balls. Upon request, the golf balls, both non-illuminated and/or illuminated, are ready for dispensing to the golfer for further use.

It should be noted that various other configurations of dispensing device 500 can be realized. For example, inner track 514 may be configured around and along the inner or outer perimeter of container portion 502, e.g., along the inside surface or outside surface, and may be configured to provide a downward sloping angle to facilitate the transporting of golf balls through opening 506.

With reference to FIG. 6, another exemplary embodiment for a dispensing device of dispensing subsystem 102 is illustrated. In accordance with this embodiment, a dispensing device 600 suitably comprises an opening 601 for receiving golf balls into a storage area 604, a requesting device 614, such as a foot pedal or a handle, a discharge tube 612, and a discharge opening 618. To facilitate the transmission of the golf balls into storage area 604, dispensing device 600 may include a delivery tube 608.

Storage area 604 is suitably configured to store numerous golf balls, for example 500 golf balls or less, prior to delivery to discharge tube 612. In accordance with one embodiment, storage area 604 may include a "pre-bake" area 606, i.e., an initial illumination source prior to final illumination of the golf ball, to suitably initiate the illumination of the golf balls if desired. Upon request by the golfer, such as through the use of requesting device 614, golf balls may suitably exit an opening 610 of storage area 604 and enter discharge tube 612. Opening 610 may comprise a gate-like device configured to permit the dispensing of a single golf ball, or multiple balls, upon activation by requesting device 614. Although numerous golf balls could be requested on any one occasion, dispensing device 600 preferably includes a holding area 611 configured to permit one golf ball at a time to exit opening 610, and thus enter discharge tube 612.

Upon entering discharge tube 612, a golf ball or balls may suitably travel towards opening 618 for discharging to the golfer. In accordance with an exemplary embodiment, dispensing device 600 may also include an illumination device 616 configured to provide an illumination source to the golf balls passing through discharge tube 612. Illumination device 616 may comprise any illumination source suitable for illuminating golf balls. Regardless of whether the golf balls are illuminated or non-illuminated, opening 618 can suitably dispense the golf balls onto a mounting platform 602, or directly to a teeing area. In addition, mounting platform 602 may be adjacent to, or part of, the teeing area without departing from the scope of the present invention.

Although various exemplary embodiments for dispensing subsystem 102 are described above, it should be noted that any device configured for storing and dispensing golf balls may be utilized in accordance with the present invention. For example, many conventional driving ranges which provide for golf ball dispensing systems having mechanical chains, levers or conveyors, or hydraulic or pneumatic systems, for the transporting of golf balls from a storage area may also be utilized. Further, it should be noted that the illumination device need not be incorporated into the dispensing device, but may be configured along side the dispensing device, for example, either directly coupled to the dispensing device or separated apart from the dispensing device.

In addition to the above functions, dispensing subsystem 102 may also be capable of additional functionality enhancing the practice and/or teaching of golf, including, without limitation, the gauging and displaying of the golfer's swing speed, such as, for example, by conventional radar systems, the gauging and displaying of the golfer's swing tempo, the gauging and displaying of the distance from the golfer to each of the targets, and the directing of laser or other light beams down and/or along the golfer's intended target line to facilitate proper golf alignment with the target area. Moreover, these additional features may be provided within a dispensing device, such as dispensing device 500 or 600, or may be suitably provided by separately located devices approximate the golfer.

Target Subsystem

Target subsystem 104 is suitably configured to permit a golfer to locate and identify the target area while addressing the golf ball so that the golfer may attempt to land the golf ball within the target area. The target area of target subsystem 104 may be configured in various shapes, such as the design of a putting green, a circle, an octagon and the like, and/or as a single vertical pole or "flagstick" design. Preferably, target subsystem 104 comprises a rigid frame, such as, for example, steel, fiberglass, or plastic tubing and the like, and includes a covering, such as netting, attached to the tubing frame and placed over the target area. Moreover, the tubing frame preferably has extruded perimeters which include fluorescent-like or other brightly colored members so as to be visible from the teeing area. However, the tubing frame may also be configured without colored members. To facilitate the identification of the target area during night-time conditions, i.e., conditions without external lighting, the golf target is preferably illuminated. In addition, an exemplary target subsystem 104 may comprise a plurality of golf targets of similar or different sizes, shapes, and orientations.

Figure 2:
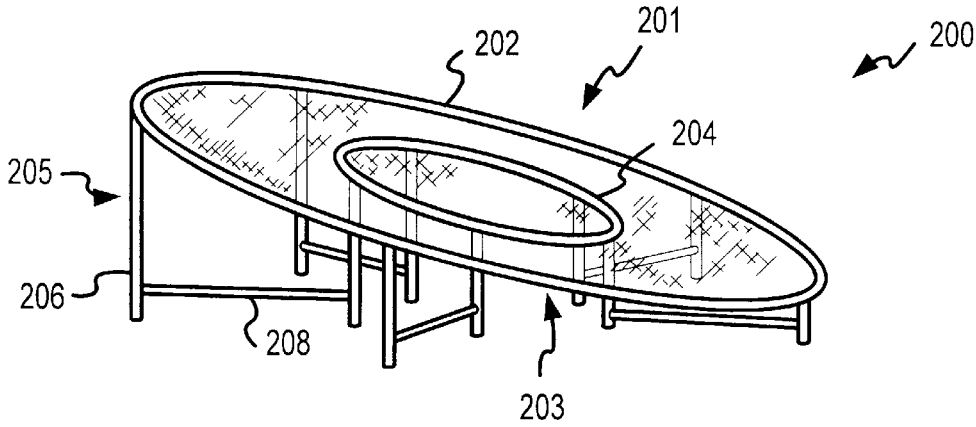
FIG. 2 is a perspective view of a golf target subsystem in accordance with an exemplary embodiment of the present invention.

With reference to FIG. 2, a exemplary embodiment of a target subsystem 200 is shown with a target area 201. In accordance with this embodiment, target area 201 comprises a freestanding, frame 203. Preferably, frame 203 comprises tubular steel members and the like having various cross-sectional configurations. However, frame 203 may also be comprised of fiberglass, or plastic tubing and the like, or a mixture of all components without departing from the scope of the present invention.

Preferably, frame 203 is raised above the ground, at various lengths, by way of a support structure 205, such as, for example, a structure similar to that of a playground jungle gym. In accordance with this aspect, support structure 205 may comprise one or more vertical legs 206 and one or more cross supports 208 suitably configured to stabilize and support frame 203 and target area 201. Preferably, support structure 205 is configured to provide a "sloped" target area 201 for the golfer to suitably identify from the teeing area. Accordingly, support structure 205 may be configured in a permanent position or may be rotatably adjustable to different orientations suitable for the golfer, i.e., adjustable to different heights and angles depending on different design layouts and criteria.

Figure 3A:
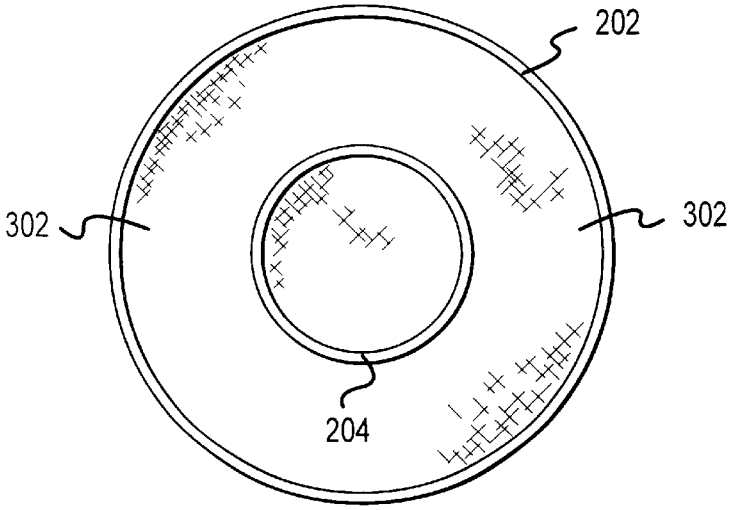
FIG. 3A is a top view of a golf target area in accordance with an exemplary embodiment of the present invention.
Figure 3B:
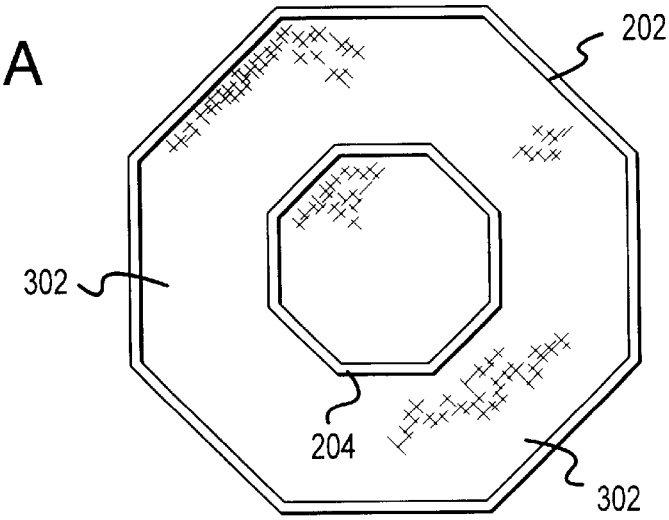
FIG. 3B is a top view of a golf target area in accordance with another exemplary embodiment of the present invention.

In accordance with an exemplary embodiment, frame 203 is configured in a substantially round-like design, such as for example, a circle, as shown in FIG. 3A, or an octagonal shape, as shown in FIG. 3B. However, frame 203 may also be configured in various other shapes, such as, for example, the design of a conventional putting green and/or as a single vertical pole or "flagstick" design to provide various configurations of target area 201 without departing from the scope of the present invention.

In accordance with a preferred embodiment, target area 201 is configured to permit golfers to distinguish between varying degrees of successful shots. Accordingly, frame 203 may comprise an inner ring 204 and an outer ring 202. Further, frame. 203 may comprise additional rings of varying dimensions to facilitate the identification of varying degrees of successful shots. For example, frame 203 may include a smaller, centralized target, e.g., a "bulls-eye" target, within inner ring 204, within outer ring 202, or within both rings 202 and 204.

In addition, the smaller target, as well as rings 202 and 204 may be configured at varying dimensions. For example, the smaller target may comprise a two-foot by two-foot area, or a slightly smaller or larger area, in a circle, square, diamond or rectangular configuration and the like. Meanwhile, inner ring 204 may comprise a five to twenty-five foot diameter circle, octagon, square or other shaped target area. Further, outer ring 202 may suitably comprise a fifteen to fifty foot diameter circle, octagon, square or other shaped target area. Thus, the dimensions and shape of the smaller target, and rings 202 and 204 are not limited to any particular sizes or configurations in accordance with the present invention.

In accordance with another exemplary embodiment, frame 203 is preferably covered with a barrier netting. The barrier netting utilized may comprise the type of netting normally installed vertically along the perimeter of golf courses to shield certain areas from wayward golf balls. In addition, the barrier netting may also be comprised of any type of high-strength netting, such as conventional fish netting. Moreover, the barrier netting may comprise any other type of fabric-like material, such as canvas, polyester and the like, or leather, rubber or other similarly configured materials. Accordingly, the barrier netting may comprise any type of netting or covering suitably configured to provide a cover for frame 203. Preferably, the barrier netting is configured to cushion or soften the impact of a golf ball landing within target area 201, such as within ring 202 or ring 204.

With reference to FIG. 3A, in accordance with this exemplary embodiment, a barrier netting 302 is suitably attached to frame 203, such as by attachment to ring 202 and ring 204. Preferably, netting 302 is partially rolled around the perimeter of frame 203 in a manner to secure netting 302 to frame 203. Barrier netting 302 may be secured to frame 203 by using various devices, such as, for example, nylon ties, wiring, hose clamps, hooking devices or other suitable components.

In accordance with another aspect of the present invention, barrier netting 302 may be suitably configured to permit any golf balls landing within target area 201, either by direct flight or by bouncing onto, to be collected to a designated area of target subsystem 104. In accordance with this aspect, barrier netting 302 is configured to "droop" in a particular region such that any golf balls present within target area 201 may suitably be collected within the drooping region, such as by rolling along barrier netting 302 and into the droop region. This drooping of barrier netting 302 can be initiated or aided by the addition of weights, or through the course of time which facilitates eventual sagging of barrier netting 302. Such a result can be more readily facilitated by configuring the drooping sections in an area of frame 203 having a minimal height from the ground.

Figure 7:
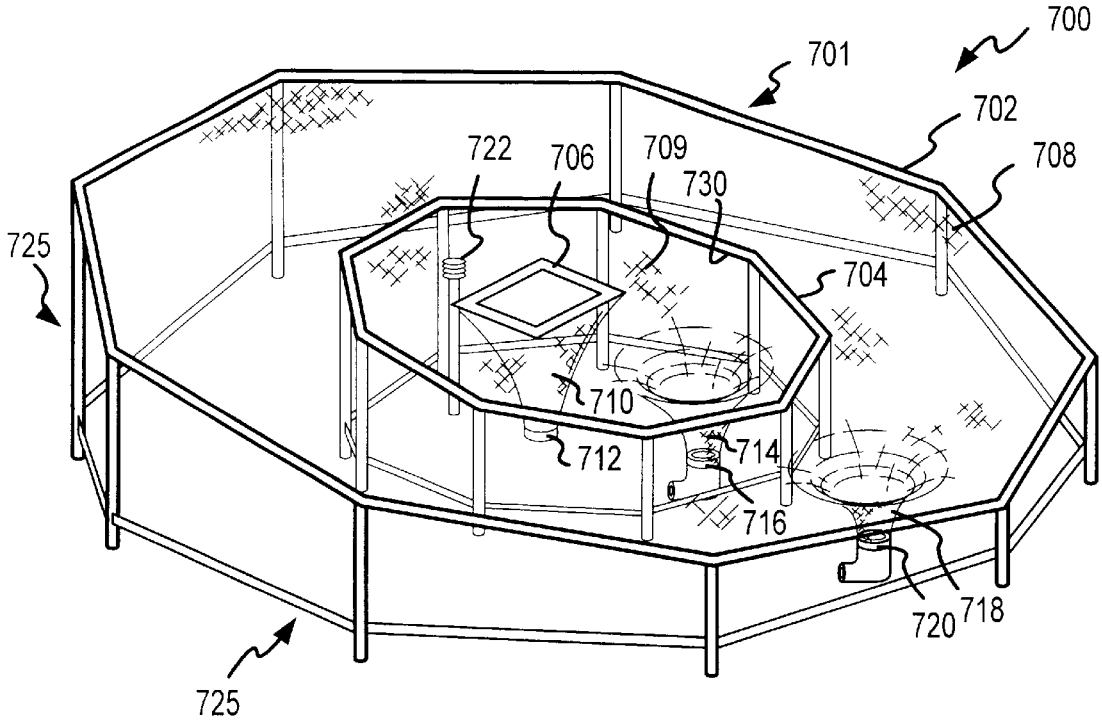
FIG. 7 is a perspective view of a golf target subsystem coupled with a detection subsystem in accordance with an exemplary embodiment of the present invention.

For example, with reference to FIG. 7, a target area 701 comprising an inner ring 704 and an outer ring 702 is illustrated. In this example, a barrier netting 707 or 709 may have respective drooping regions 718 and 714 which are configured within a planar surface that is lower than the planar surface for barrier netting 708 or 709. As such, any golf balls landing, for example, within outer ring 702 or inner ring 704, and thus onto barrier netting 708 or 709, will suitably be collected within appropriate drooping region 718 or 714.

This result can be further enhanced by suitably configuring support structure 725 with a "sloped" target area 701, and with drooping regions 714 and 718 suitably configured at a lower end of the slope. Drooping regions 714 and 718 can also be configured with ball receiving devices 716 and 720, respectively. Ball receiving devices 716 and 720 suitably comprise an annular member, such as a ring or circular clamp, having an opening therein to permit golf balls landing on target area 701 and collected within region 714 or 718 to be discharged to the ground and/or any type of container and the like. Further, ball receiving devices can comprise metal, plastic, wood or other similar materials for providing an opening to permit discharge of any collected golf balls. In accordance with this feature, due to the additional weight provided, ball receiving devices 716 and 720 can further facilitate the drooping of regions 714 and 718.

As discussed above, target area 701 may comprise an inner ring 704 and/or an outer ring 702 of varying dimensions to facilitate the identification of varying degrees of successful shots.

In addition, in accordance with another exemplary embodiment of the present invention, target area 701 may also include a smaller, centralized target 706, e.g., a "bulls-eye" target. Centralized target 706 may be suitably positioned within inner ring 704, within outer ring 702, or within both rings 702 and 704. In other words, centralized target 706 may be positioned at various locations around target area 701, similarly like a flag is positioned at various locations around a putting green. In addition, centralized target 706 may comprise various dimensions, sizes, shapes and orientations without departing from the scope of the present invention.

In accordance with another aspect of the present invention, as discussed above, target subsystem 104 may comprise frame 203 with extruded perimeters which include fluorescent-like or other brightly colored members so as to be visible from the teeing area, such as during daylight conditions. Moreover, to illuminate target area 201 or any part thereof, frame 203 may be configured with fluorescent-like components suitably attached onto its outer surface with or without other types of light sources adapted onto or within its structure. However, it should be noted that target area 201 need not be of any particular type of construction and need not be illuminated in any particular manner.

In accordance with an exemplary embodiment, with reference to FIG. 4, frame 203 suitably comprises an illuminating member 400, a light-transmissive tube 402 and tubing 404. Illuminating member 400 may comprise, for example, commercially available "light rope" or similar products, such as the illuminating devices utilized along the floors of movie theaters and the like. However, illuminating member 400 may also comprise any device capable of providing illumination, whether self-illuminating or requiring outside assistance, now known or hereinafter devised, without departing from the scope of the present invention.

For example, illuminating member 400 may comprise-commercially available "fiber optic" cable of varying thickness, such as illuminating devices utilized along the edges of swimming pools and the like. The fiber optic cable may be configured, for example, in sizes ranging from 21-strand fiber to 150-strand fiber. In accordance with an exemplary embodiment of the present invention, illuminating member 400 may comprise select fiber bundles which are contained in a sheath. Light from a remote light source, such as may used for illumination of fiber optic cabling, can be suitably directed into the collective ends of the fiber optic cable, thus facilitating illumination of illuminating member 400. In addition,.the light may be configured in a variety of color arrangements. In accordance with an exemplary embodiment, the light may be varied in color by way of a multiple-color "color wheel" or other similar device suitably configured between the light source and the ends of the fiber optic cable. As a result, illuminating member 400 may suitably provide multiple displays of color.

In accordance with an exemplary embodiment, illuminating member 400 is configured to be suitably attached to tubing 404, i.e., the tubing suitably configured to define inner ring 204 and outer ring 202. Accordingly, illuminating member 400 can be suitably fastened to tubing 404, such as on top, below or on the sides of tubing 404, by using, for example, nylon ties, wiring, hose clamps, hooking devices or other suitable components. Accordingly, upon attachment, illuminating member 400 may be covered with light-transmissive tube 402 which permits the illumination of illuminating member 400 through tube 402, thus enabling a golfer to readily identify target area 201 from the teeing area.

Tube 402 suitably comprises a foam "pool noodle" or similar foam tube with an aperture 405 located through the middle of the longitudinal axis of tube 402. Moreover, tube 402 is preferably slit along one side to create opening 403, placed around illuminating member 400 and tubing 404, and then fastened to cover both illuminating member 400 and tubing 404. However, it should be noted that other configurations can be realized, such as tube 402 being configured around tubing 404 without the application of illuminating member 400, e.g., a daytime only target area 201 without illumination. Moreover, tube 402 may also be suitably configured around tubing 404 with illuminating member 400 suitably fastened to the outside surface of tube 402.

Accordingly, when target area 201 is illuminated, the light from illuminating member 400 may be suitably diffused through or reflected from foam tube 402 to give off a distinguished "glow." In accordance with another embodiment, illuminating member 400 may comprise a selectably configurable arrangement of various colors, for example, the various colors of a light prism. Further, tube 402 may be preferably selected from various fluorescent or bright colors so that during day operations, the bright colors of tube 402 make target area 201 a readily visible and appealing place to aim golf shots.

It should be noted that frame 203 may also comprise various combinations of illuminating member 400, tube 402 and tubing 404 without departing from the scope of the present invention. For example, frame 203 may include tubing 404 and illuminating member 400 without tube 402. In addition, frame 203 may also be configured with tubing 404 and tube 402 without illuminating member 400. Further, frame 203 may comprise tubing 404 without tube 402 or illuminating member 400.

Detection Subsystem

Detection subsystem 106 is suitably configured to permit a golfer to readily determine whether a golf ball has landed within a perimeter of target subsystem 104, such as within target area 201. Upon detection of a ball within target area 201, an output signal, such as an alarm light or sound or other reporting output, may be provided by detection subsystem 106 to indicate the presence of a golf ball within the perimeter of target area 201, such as within inner ring 204 or outer ring 202. In addition, as will be described in more detail below, the accuracy of a golfer for a single practice session or game or an accumulation of various practice rounds or games may be determined.

As discussed above, barrier netting 302 may be suitably configured to permit golf balls landing within target area 201 to be collected within drooping regions 714 and 718. Moreover, drooping regions 714 and 718 can also be configured with ball receiving devices 716 and 720, which suitably comprise annular members having an opening therein, to permit golf balls landing on target area 201 and collected within region 714 or 718 to be discharged. In accordance with another aspect of the present invention, to suitably provide performance feedback to a golfer after a golf shot, detection subsystem 106 is configured to identify when a golf ball is located within regions 714 and 718 and provide a suitable output signal that is visible or audible to the golfer approximate the teeing area, or in recorded format for later viewing.

In accordance with this aspect, detection subsystem 106 suitably comprises a detector device configured to determine the presence of a golf ball within target area 701, such as on top of barrier netting 708 and 709 or inside regions 714 and 718. In accordance with this aspect, the detector device may comprise, for example, an impact switch, a microswitch, a photoelectric or laser-type sensor, an audible detector, and infra-red detector or any other electrical, mechanical or electromechanical switch or sensor capable of detecting the presence of an object. Preferably, the detector device is positioned at the lower portion of regions 714 or 718, e.g., configured within or onto ball receiving devices 716 or 720. However, detector device may also be suitably positioned at any location suitable, such as being in close proximity, below or alongside, for detecting the entry, exit or presence of a golf ball within target area 701, such as within regions 714 or 718.

Figure 8:
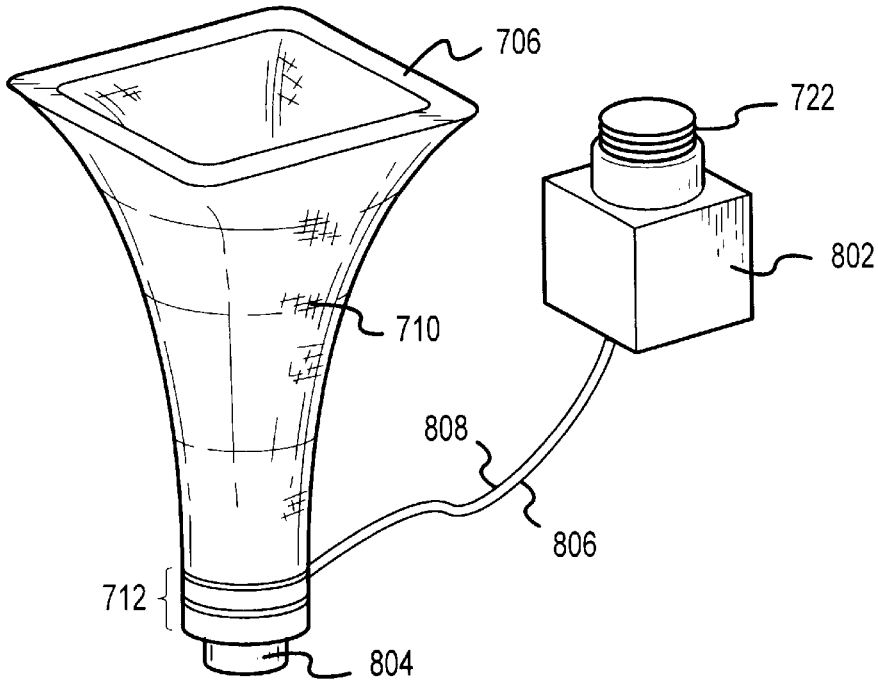
FIG. 8 is a perspective view of a detection subsystem in accordance with an exemplary embodiment of the present invention.
Figure 9:
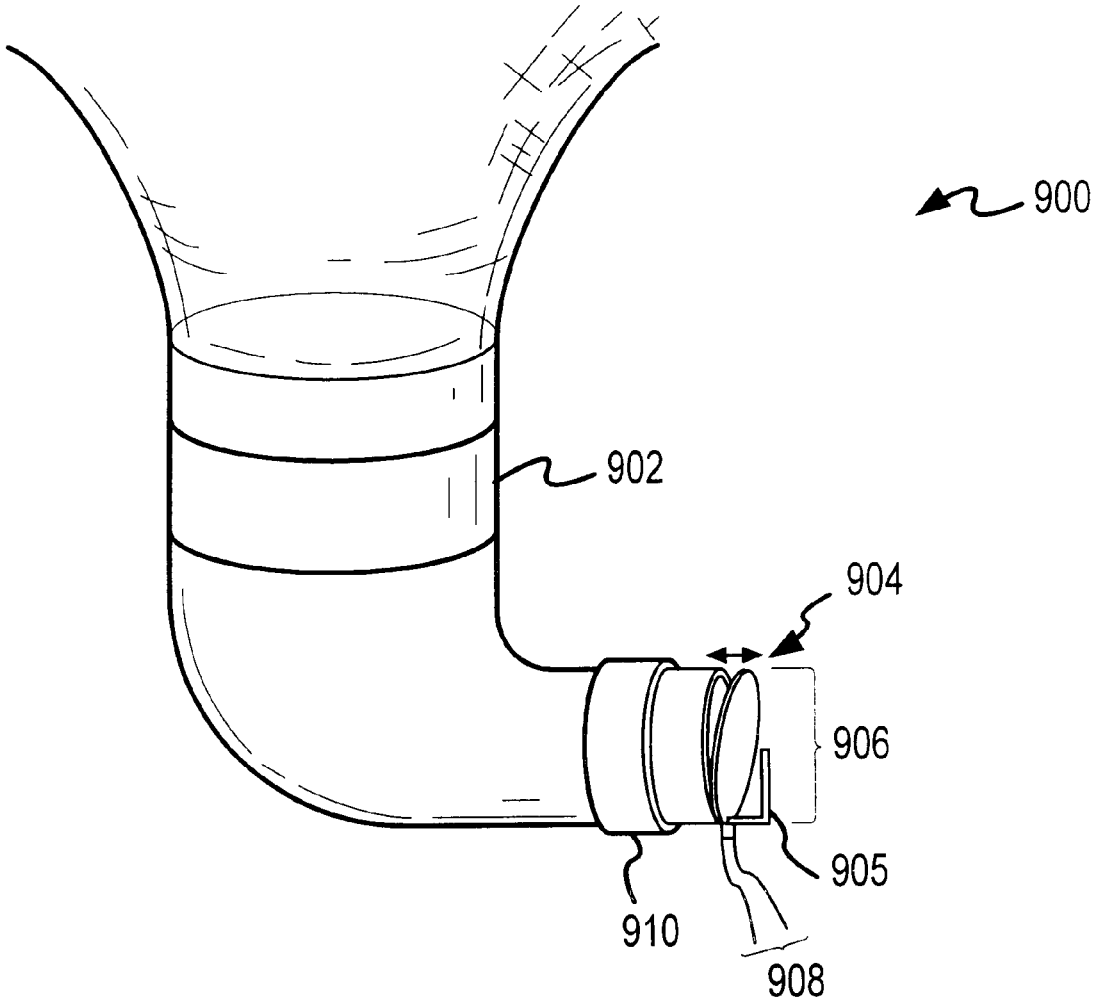
FIG. 9 is a perspective view of detection subsystem in accordance with another exemplary embodiment of the present invention.

With reference to FIG. 9, in accordance with an exemplary embodiment 900 for detecting the presence of a golf ball, a detector device 906, such as may be used with regions 714 and 718, is shown. In accordance with this exemplary embodiment, detector device 906 suitably comprises an impact-type switch. For example, as a golf ball travels within region 900 and thus within ball receiving device 902, an impactor 904 would be suitably struck by a golf ball present within device 902, thus causing impactor 904 to make contact with backing portion 905. This "contact" between impactor 904 and backing portion 905 can provide a signal transmitted through wiring connections 908 to an output device, such as, with momentary reference to FIG. 8, output device 802, as will be described below in more detail. However, it should be noted that such wiring connections 908 may be suitably replaced and/or duplicated through the use of "wireless" technology devices.

Although an impact switch is described above, it should be noted that various other switches could be applied with ball receiving device 902. For example, a microswitch, or a photoelectric or laser-type sensor 910 can be utilized to detect the presence of a golf ball within regions 714 and 718. Furthermore, any electrical, mechanical or electromechanical-type switch, now known or hereinafter devised, may be utilized in accordance with the present invention.

While the above configuration for detecting the presence of a golf ball within target area 201 is very effective, the time period between when a particular golf ball lands on target area 201, e.g., the time for a golf ball to roll along barrier netting 708, into region 718, and eventually past detector device 906 may take several seconds, for example fifteen seconds or more on some occasions. As a result, while providing accurate detection information, such a configuration is best suited for non-real-time performance feedback situations, e.g., for post-practice statistical analysis and the like. However, in accordance with another aspect of the present invention, detection subsystem 106 can suitably include a detector device configured as a motion sensor or other similar impact device that is suitably coupled to barrier netting 708 or 709 to provide a more instantaneous detection of a golf ball.

In accordance with this aspect, with reference to FIG. 7, detection subsystem 106 may include a detector device 730 comprising a motion sensor, an impact sensor, tensionometer or any other similar sensor capable of detecting the impact of a golf ball hitting barrier netting 708 or 709. For example, detector device 730 may be suitably coupled to barrier netting 709, either directly or through some other transmission device. Accordingly, upon the landing of a golf ball upon barrier netting 709, the accompanying shock waves from the impact of the golf ball can suitably trigger detector device 730. As a result, detector device 730 can provide a substantially instant output signal corresponding to the detection of the shock waves, i.e., the detection of a ball impacting a portion of barrier netting 709. Thus, the output signal from the motion detector can be suitably transmitted to an output device, such as output device 802, for further use by detection subsystem 106. In accordance with a preferred embodiment, the output signal from motion detector 730 can be configured with output device 802 to provide immediate feedback to the golfer, such as, for example, by way of an output signal or report, such as a light or sound alarm, as will be described in more detail below. In addition, it should be noted that detection subsystem 106 may include a plurality of detector devices 730 suitably configured around barrier netting 708 and 709 to provide a more accurate detection scheme.

As discussed above, target area 701 may comprise an inner ring 704 and/or an outer ring 702 of varying dimensions to facilitate the identification of varying degrees of successful shots.

In addition, target area 701 may also include a smaller, centralized target 706, e.g., a "bulls-eye" target. While centralized target 706 may be coupled to a detector device, such as an impact switch, a photoelectric, or a microswitch and the like, in a manner similar to the coupling of detector device to rings 704 and 702, i.e., through the coupling to droop regions 714 and 718, centralized target 706 is preferably coupled to a detector device through a chute-like member configured for containing golf balls which land within centralized target 706. With reference to FIG. 8, centralized target 706 may be coupled to a chute 710 for containing golf balls entering centralized target 706. Chute 710 may suitably comprise a flexible material, such as canvas, vinyl, or woven cloth, or of the same material as barrier netting 708 or 709. Moreover, chute 710 may suitably comprise a more rigid material, such as plastic, fiberglass, metal or wood and the like. At a discharge end of chute 710, a ball receiving device 712 may be suitably positioned. Device 712 is suitably configured to hold, handle and/or contain a plurality of golf balls that may enter centralized target 706, and thus chute 710. As such, balls passing into device 712 may suitably pass by a detector device 804 suitably attached between chute 710 and device 712, within device 712, or at the end thereof or in close proximity to device 712. Moreover, detector device 804 may also comprise an impact switch, a photoelectric or laser sensor, or any other electrical, mechanical or electromechanical sensor and the like. Accordingly, detector device 804 may detect the presence of a golf ball within centralized target 706. In addition, although a motion sensor or shock sensor, such as sensor 730, may be utilized for a more instantaneous indication of the presence of a golf ball within centralized target 706, due to the proximity of detector device 804 to the opening of centralized target 706, the delay in time for a golf ball to pass through chute 710 is minimal. Accordingly, a substantially instant detection of a golf ball within centralized target 706 can be realized without the use of motion sensors and the like.

As described in the various exemplary embodiments and features of dispensing subsystem 102, target subsystem 104 and detection subsystem 106, system 100 can be suitably configured to facilitate the practicing or playing of golf at night without the need for external lighting. In addition, subsystems 102, 104 and 106 can facilitate the targeting of a golf ball to a target area, with any golf balls landing o otherwise contained within the target area being readily detected. In accordance with another aspect of the present invention, a performance feedback subsystem 107, which can provide a golfer with an objective real-time and/or post-practice or game evaluation of performance, is described below.

Performance Feedback Subsystem

Performance feedback subsystem 107 is suitably configured to provide a golfer with an objective real-time and/or post-practice evaluation of performance. In accordance with this aspect of the present invention, feedback subsystem 107 may be suitably configured as a part of detection subsystem 106, or as a separate subsystem.

In accordance with one aspect of the present invention, performance feedback subsystem 107 suit ably comprises a real-time alarm system configured to provide a golfer with substantially instantaneous feedback as to the accuracy of a particular golf shot, for e example, within three seconds or less, or with delayed feedback as to the accuracy of a particular golf shot, for example, within fifteen seconds.

In accordance with an exemplary embodiment, to provide the substantially instantaneous feedback signal, feedback subsystem 107 suitably utilizes a detection device, such as detector device 730 comprising a motion sensor, an impact sensor or other similar device for detecting the impact of a golf ball, to suitably identify the landing of a golf ball onto target area 701. Upon detection of the impact of a golf ball landing within a region of target area 701, such as a golf ball landing onto barrier netting 708, i.e., within outer ring 702, onto barrier netting 709, i.e., within inner ring 704, or inside centralized target 706, feedback subsystem 107 may suitably provide a substantially instantaneous feedback signal indicative of the region detected.

In accordance with another exemplary embodiment, to provide a delayed feedback signal, feedback subsystem 107 suitably utilizes a detection device, such as detector device 804, 906 or 910 comprising an impact sensor, a microswitch, a photoelectric or laser sensor or other similar device, for detecting the presence of a golf ball within chute 710, or within regions 714 or 718. Thus, detection subsystem 106 may suitably identify to feedback subsystem 107 the landing or otherwise arrival or presence of a golf ball onto target area 701. Accordingly, feedback subsystem 107 may suitably provide a delayed feedback signal indicative of the region detected.

Regardless of which type of feedback signal is provided, feedback subsystem 107 can provide a variety of alarms to a golfer indicative of the accuracy of a particular golf shot. In accordance with this aspect of the present invention, feedback subsystem 107 can be suitably configured to provide an alarm signal corresponding to the location of where a particular golf ball has landed within target area 701. For example, in the event a golf ball lands within inner ring 704 and onto barrier netting 709, feedback subsystem 107 can suitably initiate the illumination of an illuminating member or other light associated with inner ring 704. In addition, in the event a golf ball lands within outer ring 702 and onto barrier netting 708, feedback subsystem 107 can suitably initiate the illumination of an illuminating member or other light associated with outer ring 702. Still further, in the event a golf ball lands inside centralized target 706, feedback subsystem 107 can suitably initiate the illumination of an illuminating member or other light associated with centralized target 706. Moreover, the illuminating member or light associated with rings 702 and 704 and target 706 for alarming or reporting to a golfer the landing of a golf shot within target area 701 can suitably comprise various types of lights, such as light 722, or illuminating member 400, or any other similar configuration.

Moreover, although feedback subsystem 107 can be configured to provide an alarm signal corresponding to the location of where a particular golf ball has landed within target area 701, in accordance with another aspect of the present invention, feedback subsystem 107 can suitably be configured to initiate illumination of an illuminating member not associated with a particular region where a golf ball has landed within target area 701. For example, feedback subsystem 107 may suitably provide a sound alarm indicated that a golf ball has simply landed anywhere within target area 701. Such a sound alarm can be generated by various conventional devices, such as horns, buzzers, disc or cassette players, digital sound devices, amplifiers and the. like, or other such sound alarms hereinafter devised, to provide audio feedback to the golfer. In addition, the frequency, tone and volume or other characteristics of the sound can be arranged in an unlimited number of manners, and is not limited to any particular configuration. In accordance with an exemplary embodiment, such a sound alarm can be suitably incorporated into an output device 802 located approximate target area 701. However, it should be noted that such a sound alarm could also be suitably located approximate the teeing area as well.

Continuing with this aspect of the present invention, feedback subsystem 107 may suitably provide an illuminated or other lighted alarm indicating that a golf ball has simply landed anywhere within target area 701. For example, feedback subsystem 107 could suitably illuminate a centrally located light member approximate target area 701, such as light member 722. However, such an illuminated or other lighted alarm need not be centrally located, and could be suitably located adjacent the golfer or teeing area.

In accordance with another aspect of the present invention, the illuminated or lighted alarm of feedback subsystem 107 comprises various configurations. For example, the illuminated or lighted alarm can comprise flashing alarms of various lengths. In addition, the flashing of the illuminated or lighted alarm could be representative of the accuracy, for example, one flash for golf balls within outer ring 702, or three flashes for golf balls landing inside centralized target 706. Moreover, the illuminated or lighted alarm can suitably comprise continuous lighted alarms of a fixed or variable length of time, such as, for example, the same amount of time regardless of the accuracy of a golf shot, or alternatively, one second for golf balls landing within outer ring 702, or 5 seconds for golf balls landing inside centralized target 706.

In addition, the illuminated or lighted alarm can be configured in a variety of color schemes. For example, the illuminated or lighted alarm can suitably comprise a single color, such as red or green, to indicate a golf ball has landed within target area. Further, the color of the illuminated or lighted alarm can comprise various shades of the color spectrum depending on the accuracy of the shot, i.e., the illuminated or lighted alarm can suitably comprise a plurality of colors indicative of the accuracy of a golf shot, for example, red for a golf ball landing inside centralized target 706, orange for a golf ball landing within inner ring 704, and yellow for a golf ball landing within outer ring 702. Moreover, the color of the illuminated or lighted alarm could comprise various increasingly lighter or darker shades of the color spectrum depending on the number of times a golf ball lands within target area 701, for example, beginning with shades of white for early in a player's round, and then turning darker as the golfer continues to land golf balls within the target area 701. Accordingly, it should be noted that the illuminated or lighted alarm of feedback subsystem 107 can be configured in a variety of manners without departing from the scope of the present invention.

As discussed above, performance feedback subsystem 107 can suitably comprise a real-time alarm or reporting system configured to provide a golfer with substantially instantaneous feedback or reports or with delayed feedback or reports as to the accuracy of a particular golf shot. As discussed, the substantially instantaneous or delayed feedback can comprise a variety of audio or visual arrangements suitably configured to indicate the success or accuracy of a single or plurality of golf shots. In accordance with another aspect of the present invention, such information regarding the success or accuracy of a single or plurality of golf shots may also be provided in a summary form available to a golfer during or after a practice round or game of golf.

In accordance with this aspect of the present invention, the information regarding performance may be suitably compiled over a selected amount of time. For example, in accordance with an exemplary embodiment, signals may be provided to feedback subsystem 107 that indicate when a golfer has initiated and completed performance. These signals could be provided from various sources, such as by a suitable device approximate the teeing area. Moreover, during the practice session or game, as a golfer hits golf balls to target area 701, feedback subsystem 107 can suitably determine the frequency and/or accuracy of golf balls landing within target area 701. Further, such information may be displayed for the golfer on a display device and the like to provide a current update of performance and/or a post-practice or game summary of performance.

Although the above embodiment can suitably provide information regarding performance, in the event that more than one golfer is attempting to hit golf balls to the same target area 701, it may be difficult to ascertain which particular golfer has landed various golf balls within target area 701. However, in accordance with another aspect of the present invention, feedback subsystem 107 may suitably include the identification of individual or groups of golf balls with an identifier element imprinted or otherwise marked thereon. For example, golf balls may be suitably identified with a series of alphanumeric or numeric designations, such as A100 through A150, 400 through 475, or any other manner for listing characters, now known or hereinafter devised. These designations can be suitably identified as corresponding to a particular golfer or group of golfers as desired. Moreover, the golf balls can be suitably identified with a serial bar code and the like, such as the method of coding with a Universal Product Code (UPC) as is disclosed in U.S. Pat. No. 5,439,224, and later scanned to identify the particular golf ball corresponding to a particular golfer or group of golfers. These marked golf balls can be suitably placed within dispensing device 102 in various manners. In accordance with one embodiment, golfers may suitably introduce the marked golf balls into dispensing device by way of transfer from a ball storage device or tube into opening 503, by-pass tube 508, or opening 601. Accordingly, by identifying golf balls with such an identifier, and suitably designating the golf balls with a particular golfer or group of golfers, feedback subsystem 107 can suitably track the performance of the particular golfer or group of golfers.

In accordance with another aspect of the present invention, as golf balls land within target area 701, the golf balls may be suitably collected by target subsystem 104. For example, collection containers, buckets or other similar devices can be suitably configured with target subsystem 104, such as being coupled to or placed underneath ball receiving devices 712, 716 or 720, to suitably collect any golf balls landing within target area 701. Accordingly, these collected golf balls can be suitably identified from an identifier imprinted or otherwise marked thereon to suitably determine which particular golfer or group of golfers hit a particular golf ball within target area 701. Moreover, the collected golf balls can be manually retrieved and reviewed or scanned, or can be suitably transported by various configurations of piping, conveyor or other suitable transport systems, such as the system for golf ball retrieval disclosed in U.S. Pat. No. 5,439,224. Regardless of the numerous configurations for identifying and/or determining the accuracy of a particular golfer or group of golfers, feedback subsystem 107 can suitably provide both real-time and summary information regarding performance. As a result, golfers can keep track of their performance, including the determination of any resulting improvement. Further, a variety of competitive games can be played to provide additional entertainment and enjoyment to the golfing experience.

Now that various exemplary embodiments have been described, the operation and use of an exemplary driving range by a golfer will now be described. For example, a golfer may suitably receive a golf ball, illuminated or non-illuminated, as dispensed or otherwise provided by dispensing subsystem 102, and become positioned and aligned to strike the golf ball. Due to the configuration of target subsystem 104, such as the fluorescent or brightly colored or illuminated rings or centralized target, the golfer is able to identify and locate the target area. Accordingly, upon hitting the golf ball, the golfer may effectively track the golf ball to the target area, and can visually assess or hear the results by the subsequent landing of the golf ball, i.e., the golfer can determine whether the golf ball landed within an inner ring and/or outer ring or other targets, and thus whether the shot was successful, through both visual and/or audio feedback, as well as through the receiving of summary information.

The present invention has been described above with reference to various exemplary embodiments. However, those skilled in the art will recognize that changes and modifications may be made to the exemplary embodiments without departing from the scope of the present invention. For example, although the dispensing device and targets are suitably configured for a driving range, these components may also be well suited for use on any area of open land, e.g., soccer or football fields, park areas, fairgrounds, ballparks, and/or the like. In addition, framing tube need not include any additional fluorescent or brightly colored tubing to provide a more readily visible target area, but may be suitably painted or covered with fluorescent or brightly covered paint or other like substance. Further, a target subsystem may include a plurality of targets, with each target configured substantially the same or in different manners, e.g., with or without illumination, detection devices and other components described above. These and other changes or modifications are intended to be included within the scope of the present invention, as set forth in the following claims.

We claim:

1. A system for facilitating the practice and play of golf, said system comprising:

a target subsystem for providing a target for a golfer; said target subsystem comprising a frame member and a support structure for said frame member to permit said target to be visible by a golfer, and a barrier portion connected within said frame member and configured for receiving a golf ball upon being hit by a golfer, said frame member comprising an illuminated member encircling said target such that said target is illuminated to facilitate the practicing of golf, wherein operation of said illuminated member is adjusted by a golf ball impacting said barrier portion; and a detection subsystem connected to said target subsystem for detecting presence of the golf ball within said barrier portion of said target subsystem, wherein said detection subsystem is coupled to said target subsystem and configured for providing a first signal substantially immediately after impact of the golf ball within said target, and for providing a second signal providing an indication of the accuracy of the golf shot.

2. A system according to claim 1, wherein said first signal is provided by a first detection device comprising one of a motion sensor and an impact sensor configured for detecting when a golf ball impacts said barrier portion of said target.

3. A system according to claim 2, wherein said first signal further comprises an alarm signal to provide substantially immediate feedback to a golfer that the golf ball impacted said barrier portion.

4. A system according to claim 2, wherein said barrier portion further comprises a receiving region configured within, said receiving region having a planar surface that is lower than a planar surface of said frame member to facilitate receiving of the golf ball upon receipt by said barrier portion and for dispensing the golf ball to said detection subsystem to provide said second signal.

5. A system according to claim 2, wherein said target subsystem further comprises a chute member coupled to said barrier portion and configured for maintaining the golf ball within said chute member upon direct receipt from a golfer, and configured for dispensing the golf ball to said detection subsystem to provide said second signal.

6. A system according to claim 1, wherein said ball dispensing subsystem comprises:

a container portion for containing said plurality of golf balls and having an opening for dispensing upon request by the golfer at least one of said plurality of golf balls; tracking portion for guiding said plurality of golf balls through said opening to dispense said at least one of said plurality of golf balls; and at least one illuminating device for illuminating said at least one of said plurality of golf balls.

7. A system for facilitating the practice and play of golf, said system comprising:

a target subsystem for providing a target for a golfer; said target subsystem comprising a frame member and a support structure for said frame member to permit said target to be visible by a golfer, and a barrier portion connected within said frame member and configured for receiving a golf ball upon being hit by a golfer;

a detection subsystem connected to said target subsystem for detecting presence of the golf ball within said barrier portion of said target subsystem, wherein said detection subsystem is coupled to said target subsystem and configured for providing a first signal substantially immediately after impact of the golf ball within said target, and for providing a second signal providing an indication of the accuracy of the golf shot; and a ball dispensing subsystem for containing a plurality of golf balls and being configured to dispense said golf ball for hitting to said target system, said ball dispensing subsystem comprising:

a container portion for containing said plurality of golf balls and having an opening for dispensing upon request by the golfer at least one of said plurality of golf balls;

a tracking portion for guiding said plurality of golf balls through said opening to dispense said at least one of said plurality of golf balls; and at least one illuminating device for illuminating said at least one of said plurality of golf balls, said at least one illuminating device comprising a first illuminating device for providing an initial illumination and a second illuminating device for providing final illumination of said at least one of said plurality of golf balls.

8. A system according to claim 7, wherein said at least one illuminating device comprises a black light source.

9. A golf target system for facilitating the play of golf, said golf target system comprising:

a frame having at least one perimeter configured to provide a target;

an illuminated member encircling said at least one perimeter of said frame to illuminate said target, wherein illumination of said target is modified upon a golf ball impacting said barrier region;

a support structure for said frame to permit said target to be visible by a golfer during practice;

a barrier portion connected within said frame and for receiving a golf ball hit by the golfer, and for facilitating collection of the golf ball proximate to said target system;

a first sensing device for detecting presence of a golf ball substantially immediately after the golf ball impacts said barrier portion within said at least one perimeter of said frame; and a second sensing device for confirming accuracy of a golf shot within said target.

10. A golf target system according to claim 9, wherein said illuminated member is configured to provide a plurality of colors depending on the accuracy of a golf shot.

11. A golf target system according to claim 9, wherein said first sensing device comprises one of a motion sensor and an impact sensor coupled to said barrier portion and configured for detecting when a golf ball impacts said barrier portion, and wherein said second sensing device is configured with one of a photoelectric detector and a laser sensor and coupled to a collecting region of said barrier portion.

12. A golf target system according to claim 9, wherein said frame comprises at least one of an inner perimeter and an outer perimeter, and wherein said target system further comprises a separate, second sensing device for each of said at least one inner perimeter and said outer perimeter to determine the presence of said golf ball within said inner perimeter or said outer perimeter.

13. A golf target according to claim 12, wherein said target system further comprises a centralized target configured within said at least one of said inner perimeter and said outer perimeter and having a third detection device suitably configured to determine presence of a golf ball inside an inner portion of said centralized target.

14. A golf target according to claim 13, wherein said centralized target comprises at least one of a canvas and vinyl material configured for containing a golf ball within said centralized target after the golf ball lands inside the inner portion of said centralized target.

15. A golf target according to claim 13, wherein said centralized target comprises an angular arrangement such that any golf balls landing outside of and traveling adjacent to said centralized target can be redirected to a collecting region of said barrier portion.

16. A golf target according to claim 9, wherein said golf target system can be readily repositioned in any direction from a previous location within a field of golf play.

17. A system for facilitating the practice of golf, said system comprising:

a target subsystem comprising a frame member providing a target and a support structure for said frame member to permit said target to be visible by a golfer, and a barrier portion connected within said frame member and configured for receiving a golf ball upon being hit by a golfer, said frame member comprising an illuminated member and a tubing member, said tubing member having a length-shaped to define said target, said illuminated member connected substantially along said length of said tubing and configured to adjust the illumination of said target based on receiving of the golf ball within said target subsystem;

a detection subsystem coupled to said target subsystem for detecting presence of the golf ball substantially immediately after being received within said barrier portion of said target subsystem, and for determining the accuracy of the golf ball within the target, and a dispensing subsystem for containing a plurality of golf balls and being configured to dispense said golf ball for hitting to said target system, wherein said ball dispensing subsystem comprises:

a container portion having a region for containing said plurality of golf balls and having an opening for dispensing upon request at least one of said plurality of golf balls;

a tracking portion for guiding said plurality of golf balls from said containing region through said opening to dispense said at least one of said plurality of golf balls, and an illuminating device for illuminating said at least one of said plurality of golf balls prior to dispensing of said at least one of said plurality of golf balls.

18. A system according to claim 17, wherein said detection subsystem is configured for providing a first alarm signal substantially immediately after receipt of the golf ball within said target, and for providing a second alarm signal providing confirmation of the accuracy of a golf shot within said target.

19. A system for facilitating the practicing of golf, said system comprising:

a target subsystem comprising a frame member providing a target and a support structure for said frame member to permit said target to be visible by a golfer, and a barrier portion connected within said frame member and configured for receiving a golf ball upon being hit by a golfer;

a detection subsystem coupled to said target subsystem and being configured for providing a first signal substantially immediately after impact of the golf ball within said target, and for providing a second signal providing an indication of the accuracy of a golf shot within said target; and a dispensing subsystem for containing a plurality of golf balls and being configured to dispense said golf ball for hitting to said target system, wherein said ball dispensing subsystem comprises a container portion having a region for containing said plurality of golf balls and having an opening for dispensing upon request at least one of said plurality of golf balls, a tracking portion for guiding said plurality of golf balls from said containing region through said opening to dispense said at least one of said plurality of golf balls, and an illuminating device for illuminating said at least one of said plurality of golf balls prior to dispensing of said at least one of said plurality of golf balls, said illuminating device comprising a first illuminating device for providing an initial illumination and a second illuminating device for providing a final illumination of said at least one of said plurality of golf balls.

20. A system according to claim 19, wherein said target system further comprises an illuminating member configured along sa at least one perimeter of said frame to provide an illuminated target, such that operation of said illuminating member is controlled through assessment of one of said first signal and said second signal.

* * * * *